United States Patent [19]

Mateo Maria

[11] Patent Number: 4,927,107

[45] Date of Patent: May 22, 1990

[54] SUPPORT FOR RECLINABLE BOARDS

[76] Inventor: Ramon Mateo Maria, Narciso Monturiol Street s/no. 08339, Vilassar De Dalt, Barcelona, Spain

[21] Appl. No.: 317,370

[22] Filed: Mar. 1, 1989

[51] Int. Cl.[5] ..... A47G 29/02

[52] U.S. Cl. ..... 248/240.4; 108/134; 292/263

[58] Field of Search ..... 248/240, 240.1, 240.3, 248/240.4, 291; 292/263; 108/134, 47, 48, 6, 81, 82, 80; 16/346

[56] References Cited

U.S. PATENT DOCUMENTS

| | | | |
|---|---|---|---|
| 335,265 | 2/1886 | Winans | 248/240.4 |
| 734,757 | 7/1903 | Schuehle | 108/80 |
| 1,224,129 | 5/1917 | Bohn | 248/240.4 |
| 1,503,690 | 8/1924 | Kroschel | 248/240.1 |
| 1,677,620 | 7/1928 | Cummings | 248/240.1 |
| 1,753,423 | 4/1930 | Kroschel | 248/240.1 |
| 2,284,003 | 5/1942 | Luppert | 108/82 |
| 2,716,044 | 8/1955 | Overby | 108/134 |
| 2,943,896 | 7/1960 | Gaston | 108/134 |

FOREIGN PATENT DOCUMENTS

| | | | |
|---|---|---|---|
| 494978 | 8/1953 | Canada | 108/134 |
| 17730 | of 1887 | United Kingdom . | |
| 24742 | of 1896 | United Kingdom | 108/81 |

*Primary Examiner*—Ramon O. Ramirez
*Assistant Examiner*—Robert A. Olson
*Attorney, Agent, or Firm*—Cushman, Darby & Cushman

[57] ABSTRACT

Improved support for reclinable boards that consists of two arms articulated to each other, forming a folding square and presenting jamming and releasing systems, that has been structured for reliable practical positions. Simple and functional constitution that permits reclining the board in different positions. For achieving these, the support has two arms (1 and 2) joined to each other in which common point (3) joins a crosspiece (10) which through its other end joins the axis (8) where a leg compass is joined (4 and 5) through which ends (6 and 7) are joined to the indicated arms. The mentioned crosspiece is provided with a longitudinal slot (9) where the axis slides (8) selectively engaging a series of upper inlets (11) of the slot in order to maintain the board in different angular positions.

3 Claims, 1 Drawing Sheet

SUPPORT FOR RECLINABLE BOARDS

BACKGROUND OF THE INVENTION

1. Field of the Invention

This invention of an improved support is to be used for kitchen tables, drawing boards and for many other applications, as it consists of two joint arms forming a folding square with a jamming and releasing system. Among the various models of this kind of supports, there are some that have a joining crosspiece attached to the upper arm and which through the lower end of the arm a link grasps a joint of the other arm while the support is unfolded. This kind of support, has the disadvantage of tending to disengage itself from the joint, with the consequent danger implied and making the support involuntarily fold, losing the function for which it had been made.

There are other models in existence which include a compass joining the arms. While the support is in a reclined position, this compass acts as jamming system. These supports are complex and besides, the compass is usually a nuisance for the user, who might kick the support with his knees when using the board. There are other traditional board supports, of the square type, such as those that include telescopic elements, guides, etc, which in the end are complex to use, expensive, easily damaged and unaesthetic. Many of the ordinary supports are often weak, inadequate for resisting pressures, this is why their practical utility is reduced.

SUMMARY OF THE INVENTION

Contrary to all these other supports that have been described, the support for reclinable boards, referred to in this report, is very solid, secure, easy to handle and allows the board to be reclined in many different positions without having any special construction, so that its industrial production does not imply any increase pricewise.

As a consequence, the support has two arms linked by a small compass that through the joining axis between its legs slides on a slide gap that includes a series of inlets forming a rack in a crosspiece interposed between the two legs of the compass. The inlets selectively link the axis in order to maintain the upper arm and the board fixed to it in different positions.

The crosspiece in its upper end is joined to the joining axis between the two arms and is related to the releasing system through a joining element. In order to make the explanation clearer, a picture is enclosed in which a practical case is shown. This is just an example of the various uses of this invention.

GENERAL DESCRIPTION OF THE PREFERRED EMBODIMENTS

Figure 1:
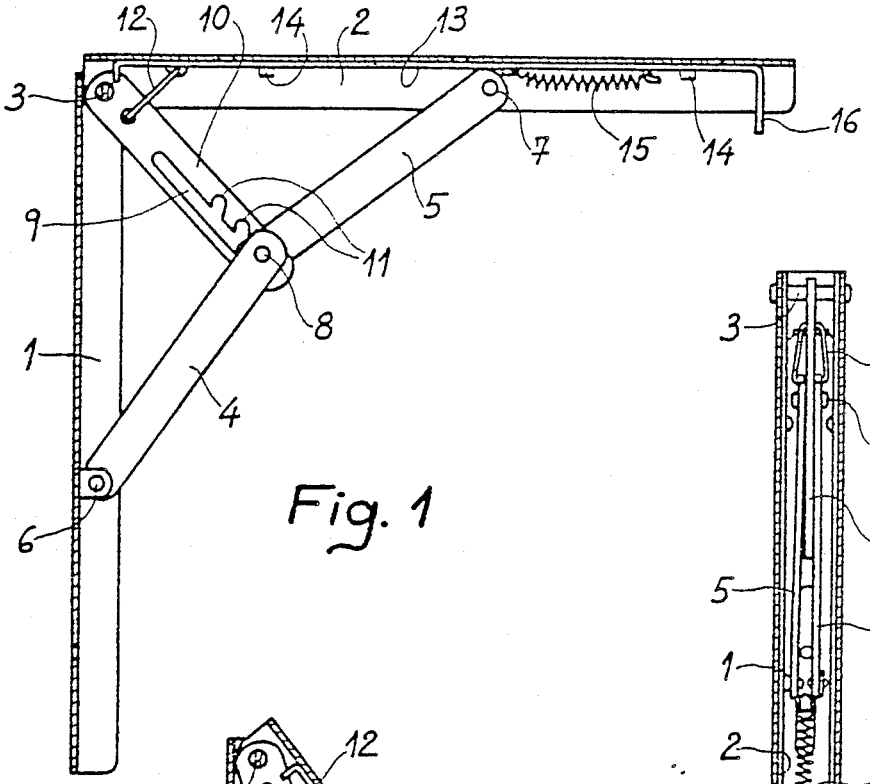
FIG. 1, is a view of the elevated longitudinal section of the support in the open position.
Figure 3:
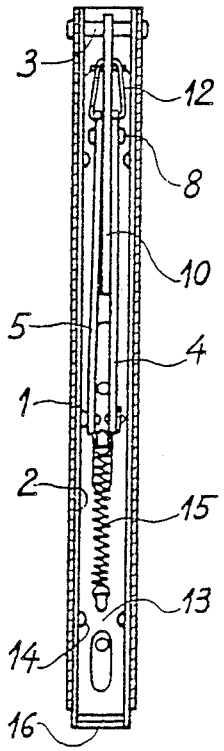
FIG. 3, corresponds to an elevated view of the back side of the support in a folded position and in order to get a clearer view, the intermediate part of the back arm has been omitted.
Figure 2:
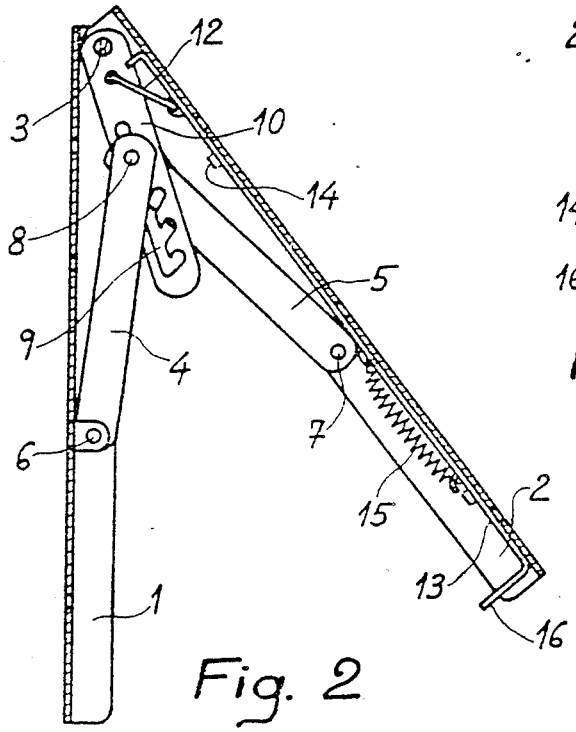
FIG. 2, is a similar view to the one shown in picture 1, in a semifolded position.

As seen in the FIGS., the referred support is comprised of two "U" shaped arms 1 and 2 joined at the confluence area through a pin 3. Arm 1 has holes in its intermediate part where it will be fixed to a wall or facing, while arm 2 has other holes where the board will be fixed to an object (not shown).

Arms 1 and 2 are related to each other by a compass whose legs 4 and 5 are joined respectively about axis 6 and 7 to arms 1 and 2. Axis 8 joins the compass' legs and slides on a slide gap 9 made in one crosspiece 10 interposed between the abovementioned legs providing a balance of strength and which is joined at its upper end to the pin 3. The slide 9 has an upper series of inlets 11 in which it is possible to fit axis 8 in a way by which the upper arm 2 is able to maintain itself in different positions and, as a consequence, the board gets fixed to that arm.

The crosspiece 10 at its upper end is joined by a "V" shaped rod 12 to the back end of plate 13 which runs parallel to the inside of the upper arm 2. Plate 13 is guided by internal pressing 14 of the same arm and pulled by spring 15 towards the back part of that arm, in a way that makes crosspiece 10 move smoothly downwards. This places the inlets 11 of the slide 9 on the axis 8 of the joint between legs 4 and 5 of the compass. Plate 13 is used to disengage axis 8 from the inlets 11 of the slide 9 of the crosspiece 10 by means of the rod 12. This is done by pulling the plate forward against the spring force 15 through a wing 16 provided at the front end of the plate. This traction determines the oscilation of the crosspiece upwards in a way that the inlets 11 are separated from axis 8 allowing the oscilation of the upper arm 2 downwards, during which axis 8 slides on the slide 9 until it produces the engagement between the axis and one of the inlets when wing 16 is released or until the support is completely folded by engaging the upper arm 1 to the back arm 2, an engagement due to the "U" shaped area of the arms and to having a "U" shape bigger in the first one than in the latter. In this position, the board is completely folded and the support completely flat occupying a very small space allowing the folding position in a way that the board is attached to the wall on which the support had been set up.

The object of this invention can be put into practice in other ways that would be different only in detail from the one shown in the picture as an example, but in any way it would have the protection quoted. This improved support could be produced for reclinable boards, in any shape and size, with the most adequate means and materials and the most convenient accessories, as it is all implied in the spirit of the claim.

What is claimed is:

1. A support for a reclinable object comprising two arms each having first and second ends, the first ends of said arms being pivotally joined together for movement about a common axis between folded and extended positions, releasable support means for maintaining said arms in said extended position, said releasable support means including first and second legs each having first and second ends, said respective first ends of each said leg being pivotally attached on a said respective arm and said respective second ends of said legs being pivotally connected on a common pin member, a cross leg member having one end pivotally connected to said common axis and another end having a plurality of engagement positions each for pivotally receiving said common pin member and means for releasing said common pin member from a said respective engagement position.

2. The invention as claimed in claim 1 wherein said means for releasing said common pin member includes a plate member carried by said second arm and slidable between an engaged and a releasing position, said first end of one of said legs being connected to said plate member so that when said plate member slides from said engaged to said releasing position, said common pin member is released from said respective engagement position.

3. The invention as claimed in claim 2, wherein spring means are provided for urging said plate member from said releasing position to said engaged position.

* * * * *